US010293897B2

(12) United States Patent
Ruiz

(10) Patent No.: US 10,293,897 B2
(45) Date of Patent: May 21, 2019

(54) STABLE FISHING RAFT

(71) Applicant: Elias Ruiz, Hughson, CA (US)

(72) Inventor: Elias Ruiz, Hughson, CA (US)

( * ) Notice: Subject to any disclaimer, the term of this patent is extended or adjusted under 35 U.S.C. 154(b) by 0 days.

(21) Appl. No.: 15/650,682

(22) Filed: Jul. 14, 2017

(65) Prior Publication Data

US 2017/0355427 A1 Dec. 14, 2017

Related U.S. Application Data

(63) Continuation-in-part of application No. 15/424,864, filed on Feb. 5, 2017, which is a continuation-in-part of application No. 14/281,959, filed on May 20, 2014.

(60) Provisional application No. 61/859,699, filed on Jul. 29, 2013.

(51) Int. Cl.

| | |
|---|---|
| ***B63B 35/14*** | (2006.01) |
| ***B63B 35/58*** | (2006.01) |
| ***B63B 35/73*** | (2006.01) |

(52) U.S. Cl.

CPC ..... *B63B 35/58* (2013.01); *B63B 35/14* (2013.01); *B63B 2035/738* (2013.01); *B63B 2231/50* (2013.01)

(58) Field of Classification Search

CPC ..... B63B 35/58; B63B 2035/738; B63B 2231/50; B63B 35/14

USPC ..... 114/263, 264, 266, 267

See application file for complete search history.

(56) References Cited

U.S. PATENT DOCUMENTS

| | | | | |
|---|---|---|---|---|
| 3,532,066 | A * | 10/1970 | Clemans | B63C 9/32 114/267 |
| 4,993,350 | A | 2/1991 | Peppers | |
| 5,421,283 | A * | 6/1995 | Bruggemann | B63B 5/24 114/357 |
| 6,659,822 | B1 * | 12/2003 | Dombeck | B63B 35/58 441/35 |
| 7,275,490 | B1 | 10/2007 | Sanders | |
| D629,484 | S | 12/2010 | Jackson | |
| 2010/0162938 | A1 * | 7/2010 | Halfon | B63B 35/71 114/343 |
| 2014/0020612 | A1 * | 1/2014 | Lizzio | B63B 35/731 114/55.56 |

OTHER PUBLICATIONS

Formex WorkFloats downloaded from http://www.formex.com/work-floats/ on Mar. 14, 2017, publication date unknown.

(Continued)

*Primary Examiner* — Anthony D Wiest

(74) *Attorney, Agent, or Firm* — Etherton Law Group, LLC

(57) ABSTRACT

A stable fishing raft that is easily transportable to the water without a trailer and has a deck large enough to easily and securely carry fishing gear. The deck and bottom are flat, and the sides are perpendicular to the deck and bottom. The deck is connected to the bottom at the bow and stern with a circular arc. The core of the raft is a buoyant foam, preferably polyurethane, and covered in a water-resistant resin, preferably polyethylene. The raft is steerable and propelled by paddle or trolling motor that attaches to a removable motor mount. In a preferred embodiment the raft has a recessed accessory track and a series of recessed rings on the deck to receive the bottom edge of a bucket and hold it in place as a seat. Rafts can be joined together with couplers.

19 Claims, 17 Drawing Sheets

(56) References Cited

OTHER PUBLICATIONS

Florida Sportsman, Formex Work Float review dated Apr. 1, 2013 downloaded in Jul. 2017 from http://www.floridasportsman.com/2013/04/01/formex-work-float/.
JLS Marine Otter Island downloaded Jun. 2017 from http://www.jlsmarine.com/other/otter_island.html, publication date unknown.

* cited by examiner

STABLE FISHING RAFT

CROSS-REFERENCE TO RELATED APPLICATIONS

This application is a continuation-in-part of co-pending U.S. patent application Ser. No. 15/424,864 filed Feb. 5, 2017, which is a continuation-in-part of U.S. patent application Ser. No. 14/281,959 filed May 20, 2014, which claims the benefit of U.S. Provisional Patent Application 61/859,699 filed Jul. 29, 2013.

FIELD OF INVENTION

This invention relates generally to rafts and more particularly to steerable rafts that are stable in the water when stationary and can support people and equipment.

BACKGROUND

Fishing is one of the most popular outdoor recreational activities in the United States with over 45 million Americans taking at least one fishing trip a year. In concept the gear necessary for fishing is simple: a fishing pole with a hook and maybe some bait. In reality people need a lot more gear. A day of fishing from the bank still requires the fishing pole, a hook and bait, but it also needs a tackle box for lures, replacement hooks, sinkers, and tools for fixing the tackle to the line. A bow fisherman needs his bow, arrows, and extra points and line. A fisherman may also want a chair or stool so he can sit on the bank and stay dry, as opposed to standing all day or sitting in the mud. The fisherman may also want one or more extra poles, and a creel or cooler to hold the caught fish. Hauling all the gear from one fishing spot to another takes so much time and effort that a fisherman stays in one spot all day, regardless of whether the fish are biting there.

Beyond bank fishing, many fishermen would prefer to fish from the water. Typically they use boats, such as small skiffs, pontoon barges, or larger open boats. One problem with those boats is that they are so large that they have to be towed on a trailer, which takes fishing from the water to an unreachable expense for many people, not to mention the inconvenience of getting the boat in and out of the water and its upkeep. Further, boats, canoes, kayaks and personal watercraft are intended as primarily moving vessels and are relatively unstable while sitting stationary in the water. For example, some people fish from canoes, but canoes are wildly unstable when stationary unless the fisherman is seated in the boat, which can make it difficult to cast, to shoot an arrow, or change positions in the canoe.

It would be desirable to have a watercraft for fishing which is stable when stationary, which can be conveniently transported to and from the water, which will hold all the gear wanted for a good day of fishing, and yet be relatively inexpensive.

SUMMARY OF THE INVENTION

The present invention is a stable fishing raft that is easily transportable to the water without a trailer and has a deck large enough to easily and securely carry fishing gear. The deck and bottom are flat, and the sides are perpendicular to the deck and bottom. The deck is connected to the bottom at the bow and stern with a circular arc. The core of the raft is a rigid buoyant foam, preferably closed-celled polyurethane and covered in a water-resistant resin. If the shell is rotational molded or blow molded then filled with foam, the coating is preferably polyethylene. If the foam is shaped first then coated, the coating is preferably polyurea. The raft is steerable and propelled by paddle or motor that attaches to a removable motor mount. In a preferred embodiment the raft has a recessed accessory track, a safety line, and a series of recessed rings on the deck to receive the bottom edge of a bucket and hold it in place as a seat. Rafts can be joined together with couplers.

DETAILED DESCRIPTION OF THE INVENTION

Figure 1:
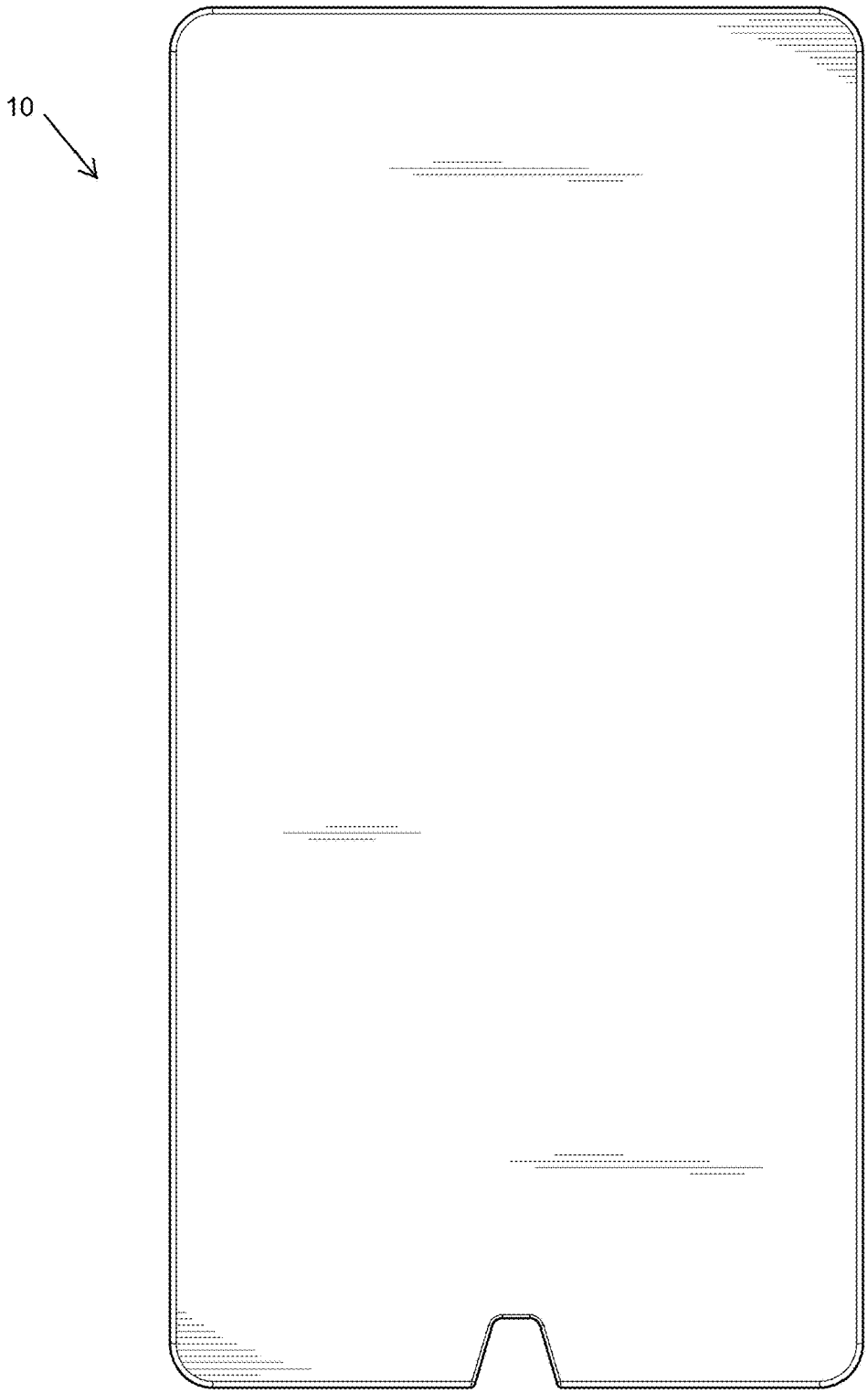
FIG. 1 is a top view of one embodiment of the raft.
Figure 2:
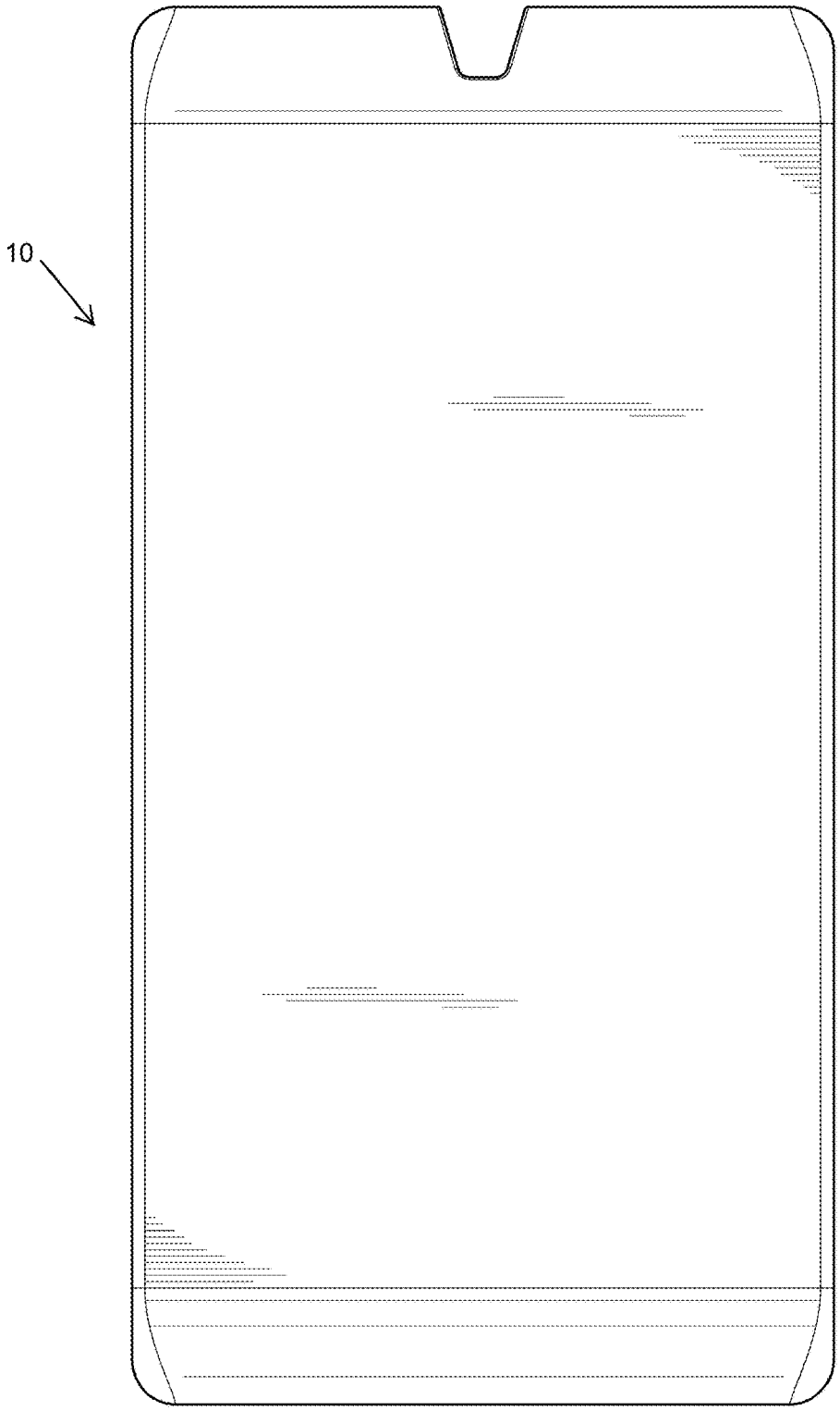
FIG. 2 is a bottom view of one embodiment of the raft.
Figure 3:
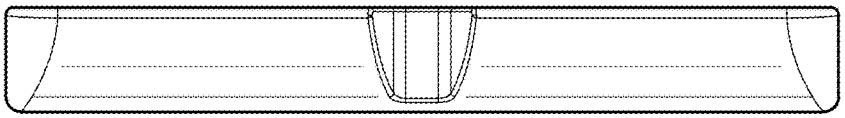
FIG. 3 is a rear view of one embodiment of the raft.
Figure 4:
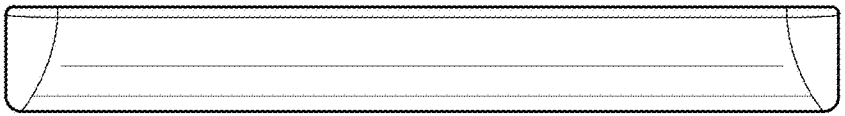
FIG. 4 is a front view of one embodiment of the raft.
Figure 5:
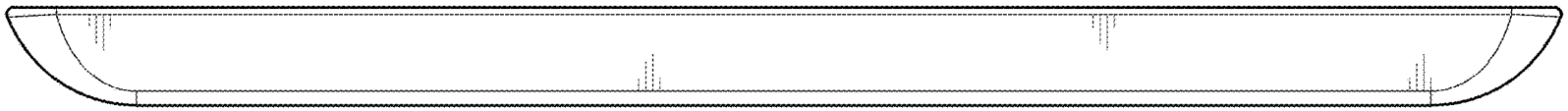
FIG. 5 is a left side view of one embodiment of the raft.
Figure 6:
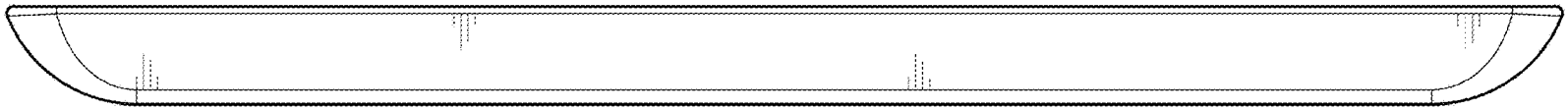
FIG. 6 is a right side view of one embodiment of the raft.
Figure 7:
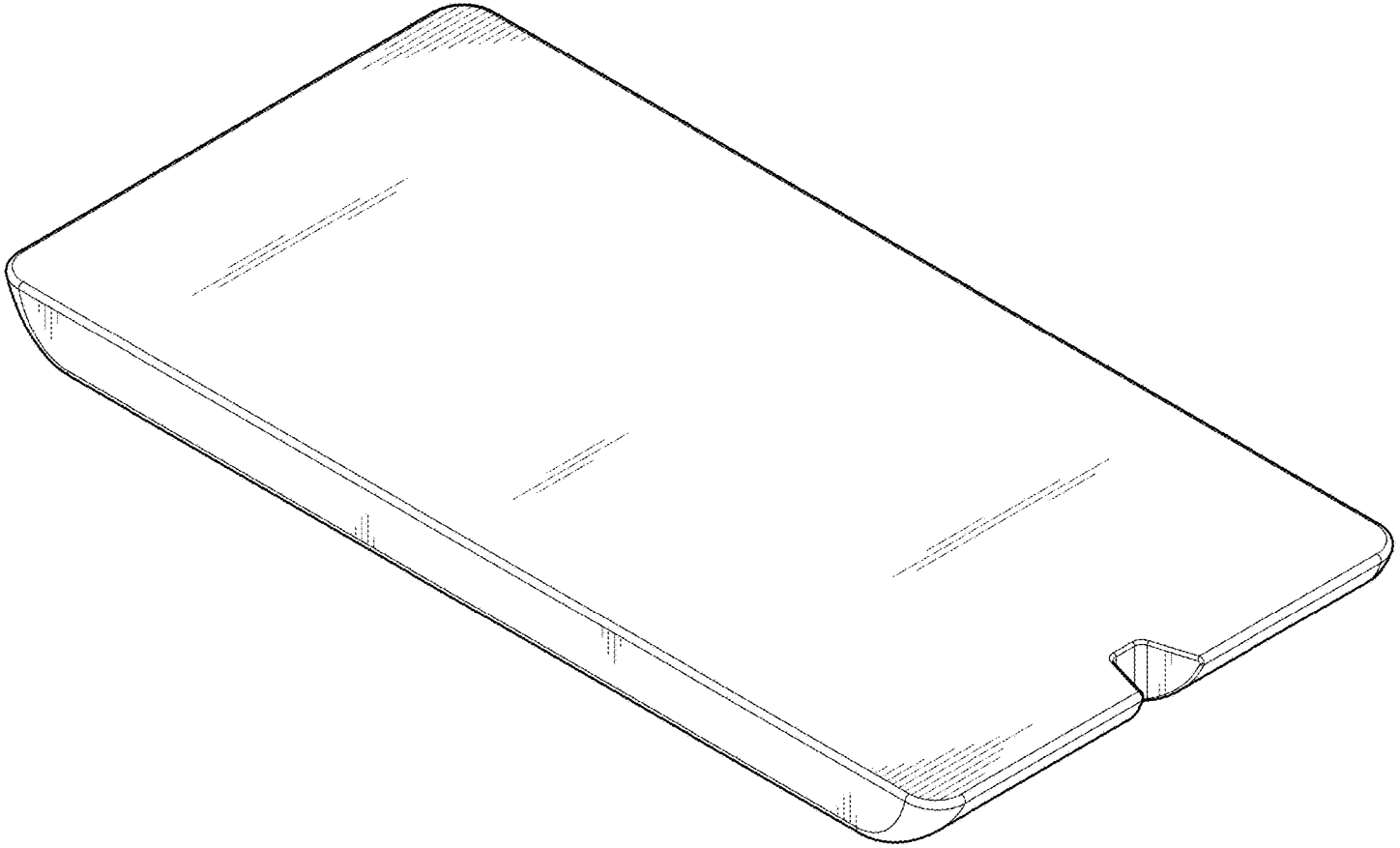
FIG. 7 is a top rear perspective view of one embodiment of the raft.
Figure 8:
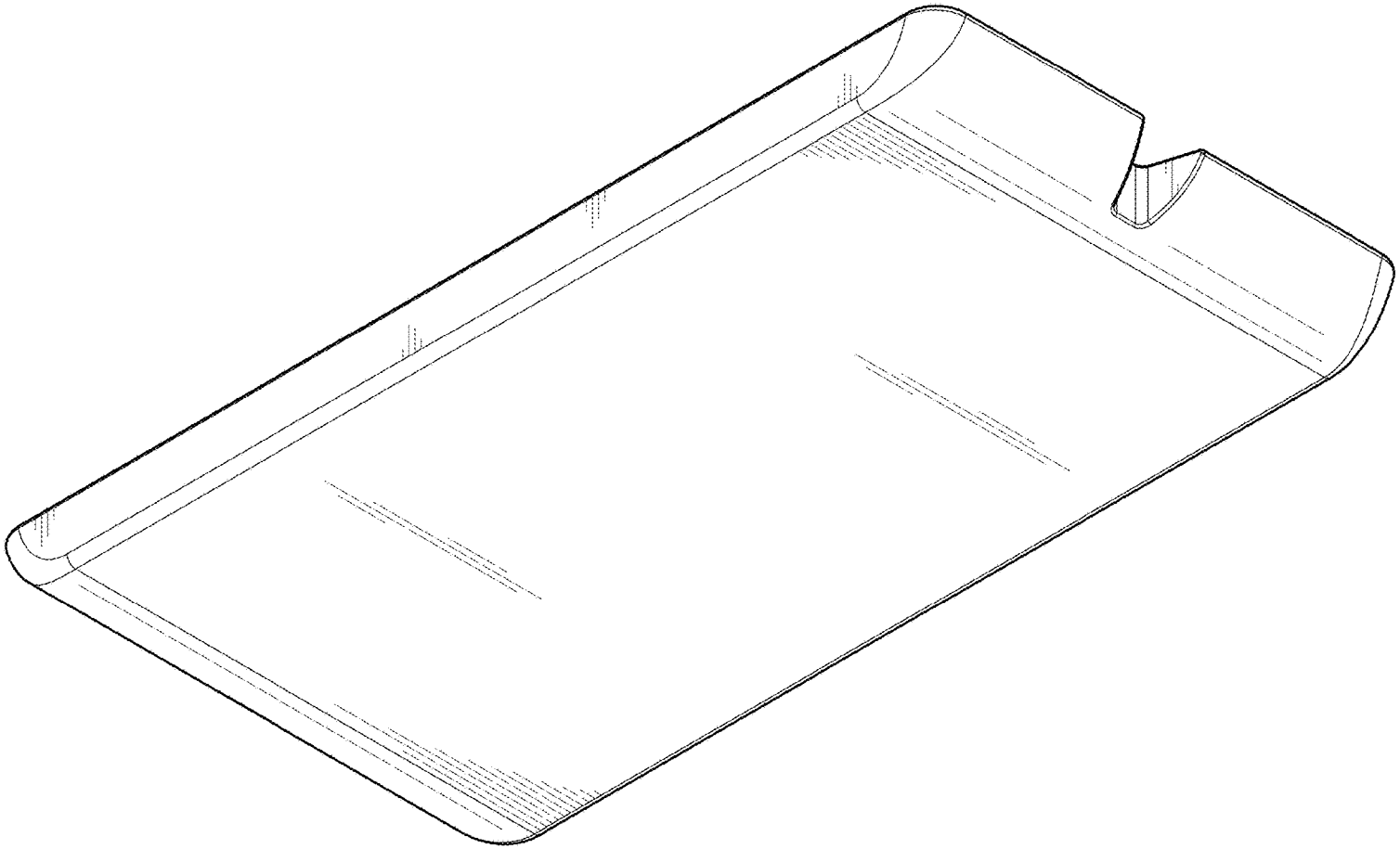
FIG. 8 is a bottom rear perspective view of one embodiment of the raft.
Figure 9:
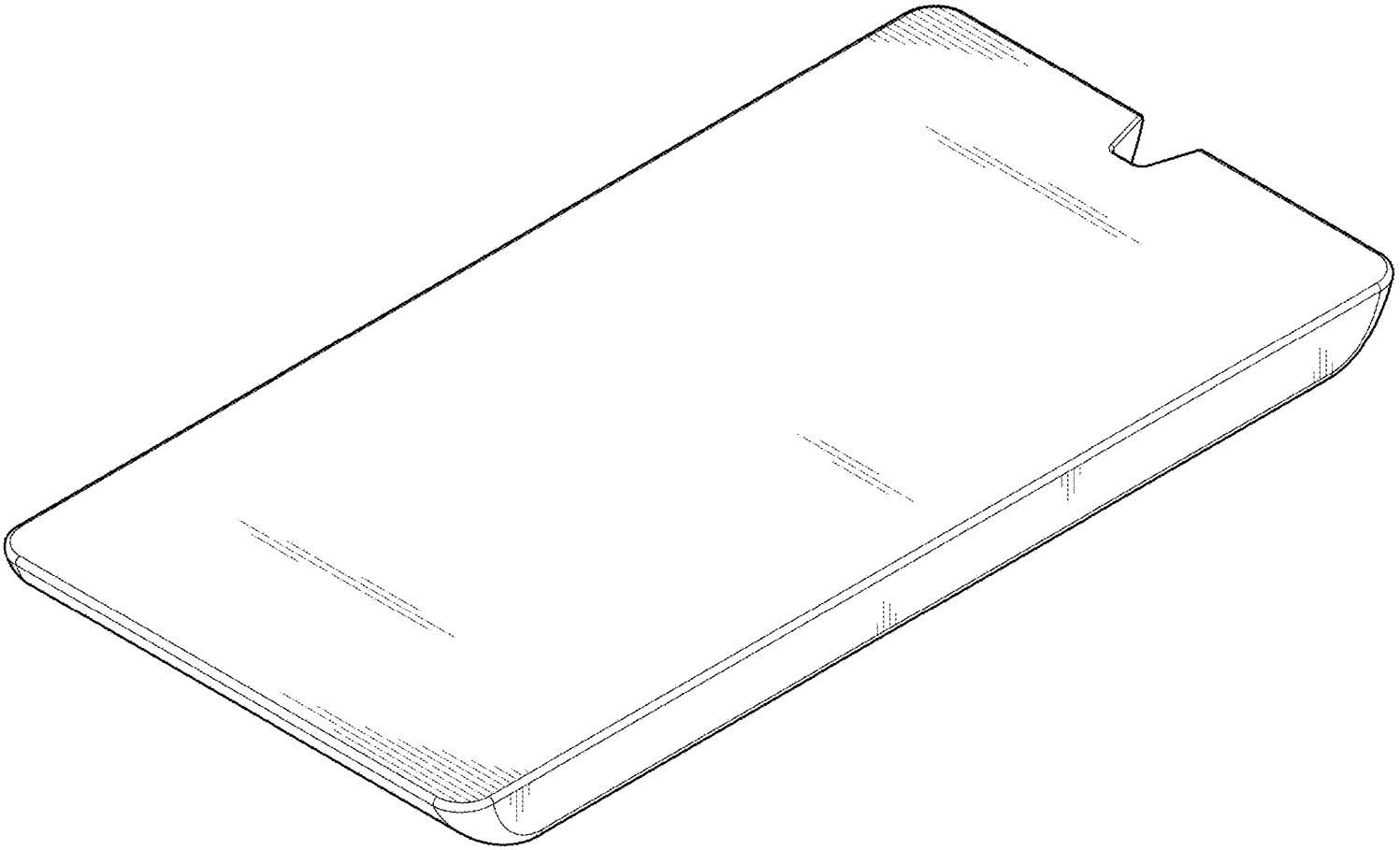
FIG. 9 is a top front perspective view of one embodiment of the raft.
Figure 10:
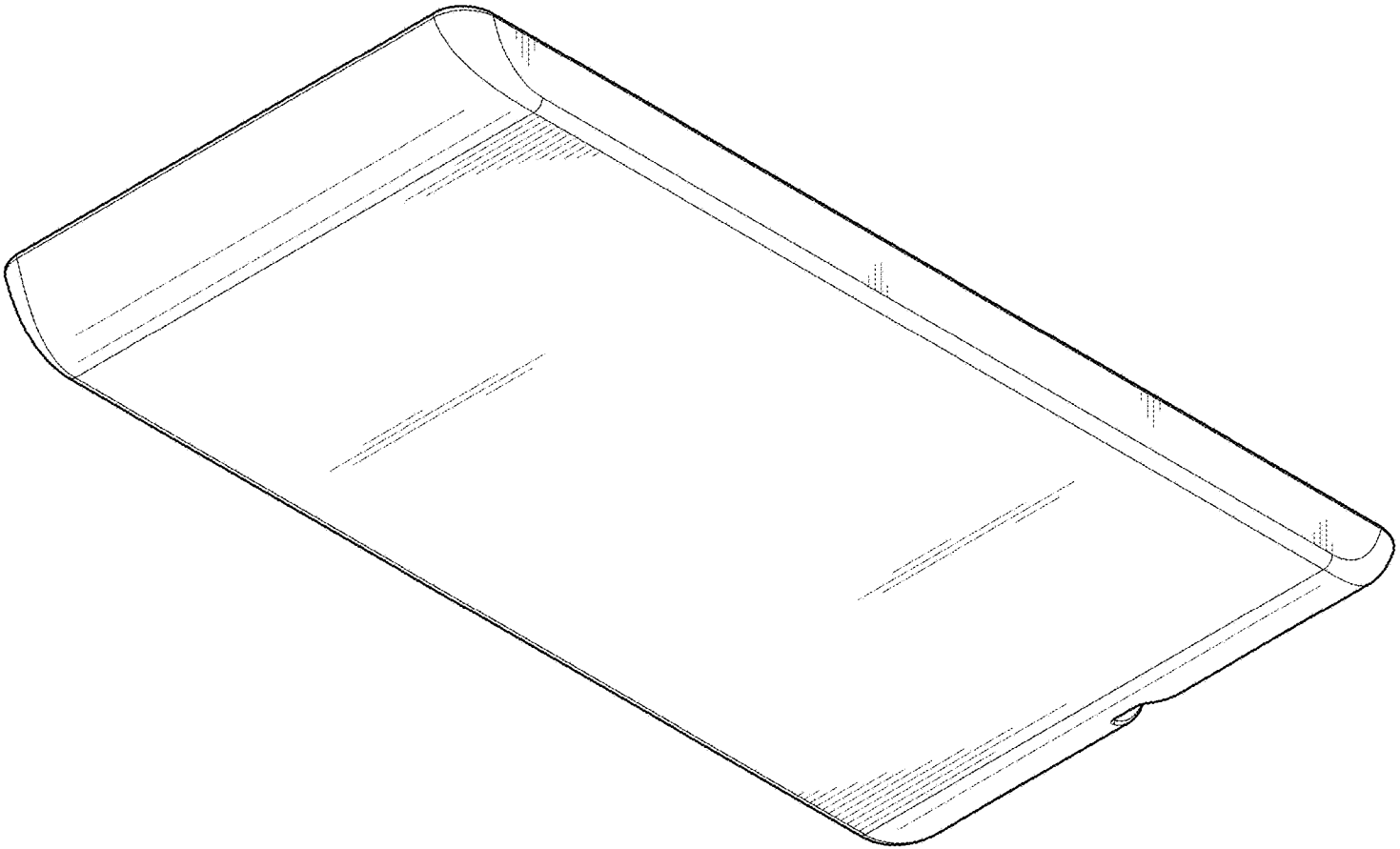
FIG. 10 is a bottom front perspective view of one embodiment of the raft.
Figure 18:
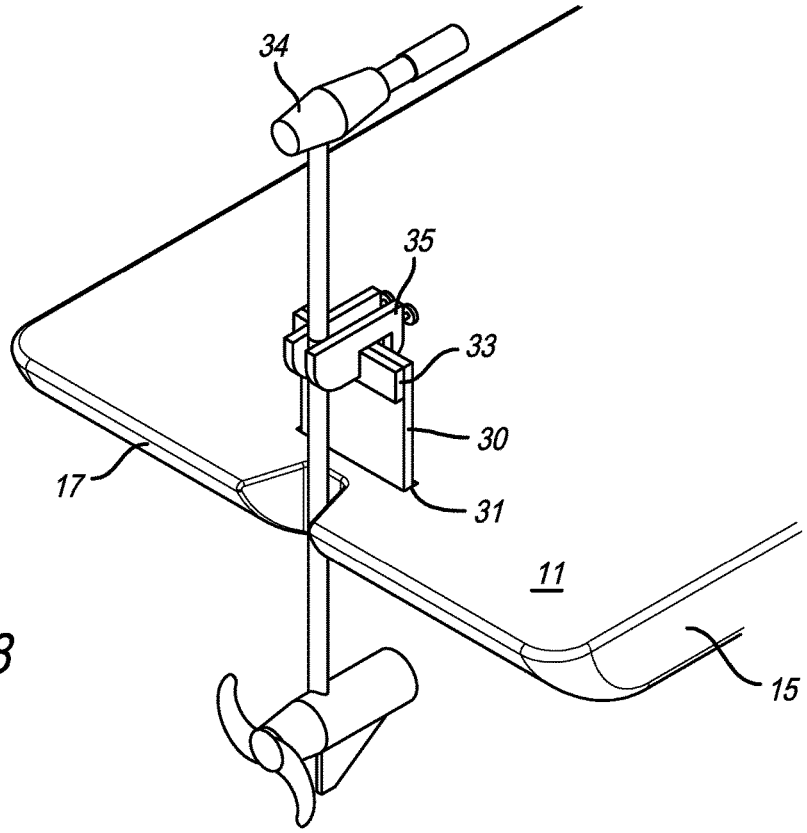
FIG. 18 illustrates a trolling motor attached to a motor mount installed in a raft.

This invention is a raft 10 having a core of a buoyant foam material. The raft 10 has a rectangular flat deck 11 and a rectangular flat bottom 12. See FIGS. 1 and 2, respectively. A flat port side 13 is perpendicular to the deck 11 and perpendicular to the bottom 12. A flat starboard side 15, shown in FIG. 6. and in part in FIG. 18, is perpendicular to the deck 11 and perpendicular to the bottom 12. See FIGS. 3, 4, and 11B. A curved bow 16 connects the front 14 of the deck 11 to the bottom 12 and a curved stern 17 connects the rear 19 of the deck 11 to the bottom 12. See FIGS. 5-10, 12 and 13. As used herein, flat means a surface without curvature such that if viewed on edge it would appear to be a straight line. A flat surface may be smooth or not smooth, where smooth means a surface without marked lumps or indentations.

The present rafts' primary use is as a stationary platform, in contrast to boats, canoes, kayaks and personal watercraft, which are intended as primarily moving vessels. Stationary, as used herein, means not moving much in relation to a point on the shore, although the raft may pitch, yaw and roll a bit while stationary due to any current and the surface characteristic of the water. The present raft provides a stable platform for activities that occur primarily in one location, such as fishing in a certain spot for many minutes or hours. The shape of the present raft makes it more stable while stationary than watercraft with sloped or curved sides. The shape in combination with a buoyant foam core make the present raft particularly stable when stationary.

Due to the improved stability of the raft, it is even stable when being propelled slowly, such as by paddle or with a trolling motor at low power. The raft can be steered hands free by the user simply shifting his weight from one side of the raft to the other side. In this way a user can steer the raft much like a skateboarder steers a skateboard.

Sloped or curve sides reduce drag, which is desirable for moving vessels. However, sloped or curved sides also decreases stability when the vessel isn't moving. The greater the curve, the less drag and less stability. Drag is not a concern for rafts most of the time, because rafts move a relatively small portion of the time they are on the water. Instead, a raft permits a user to have a stable surface while remaining stationary. Of course, a raft has to travel some distance to reach a desired fishing spot, so too much drag is not desirable because it makes the raft unwieldy as a moving vessel. The curve of the bow and stern on the present raft is set to minimize drag while traveling forward or backward. The straight sides are set to maximize stability when the raft is stationary. The present raft provides the perfect balance of maximum stability while stationary with acceptable drag getting to a desired location.

FIG. 23A-D shows the rear view of the present raft in comparison to rear views of prior-art watercraft of various shapes. "D" indicates areas of reduced displacement on prior art watercraft, relative to the present raft 10 having a flat bottom 12 and perpendicular sides 13 and 15. With the present raft 10, if traveling sideways or crabbing—that is, the raft is travelling perpendicular to its lengthwise axis—water is forced away from the deck, increasing stability. If the present raft rolls to the port or starboard side the ratio of the average depth of material submerged to the water displaced remains constant, thus countering the rolling motion. That is, one side increases in depth while the other side decreases in depth. The side that increases in depth however also experiences an increase in buoyant force. The straight sides of the present raft—vertical when the raft is at horizontal rest—retard water from coming on the deck, which would reduce buoyancy. Lateral opposing forces will be more quickly cancelled by the rectangular shape of the present raft and less likely to force water onto the deck.

In one embodiment the bow and stern have the same curvature. In a preferred embodiment the curvature is an arc of a circle having a radius r that is 42.7% larger than the thickness d of the raft: r=1.427d. See FIG. 11A. The center of the circle sits above the horizontal line H of the deck 11 at a height of h, with an arc length l an angle theta 8. In the preferred embodiment the bow and stern curvature is an arc of a circle having a radius of 8.5625 inches and the center of the circle is spaced above the deck at 2.5625 inches, h=2.5625. See FIG. 11A. The resultant arc length l is about 10.8 inches with angle θ of about 72°.

Figure 11A:
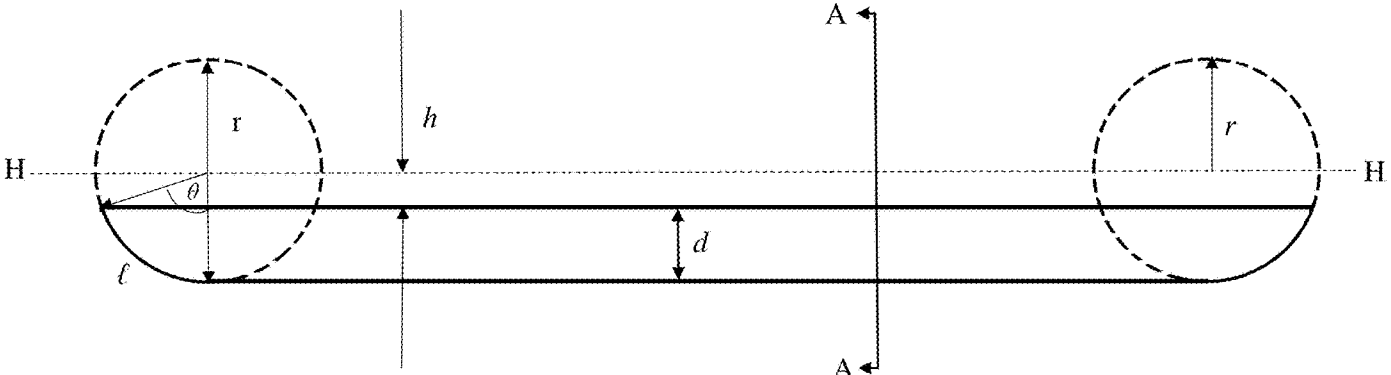
FIG. 11A illustrates the curvature of the bow and stern of the raft.
Figure 11B:
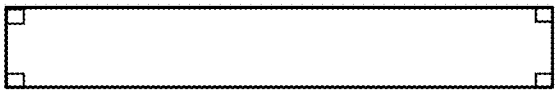
FIG. 11B is a cutaway view along line A-A of FIG. 11A illustrating the right angles of the deck, sides, and bottom.
Figure 11C:
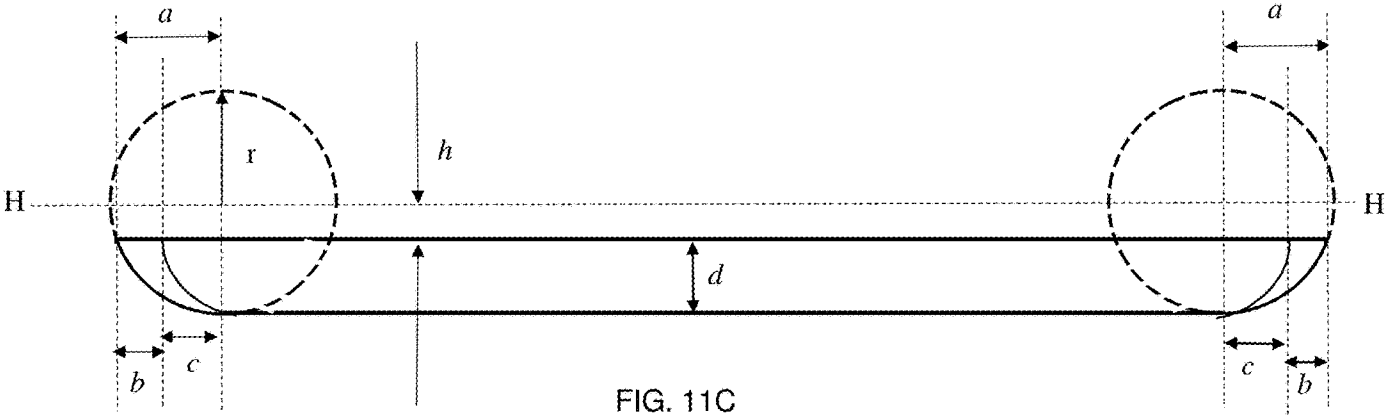
FIG. 11C illustrates the curvature of an alternative embodiment of the bow and stern of the raft.
Figure 12:
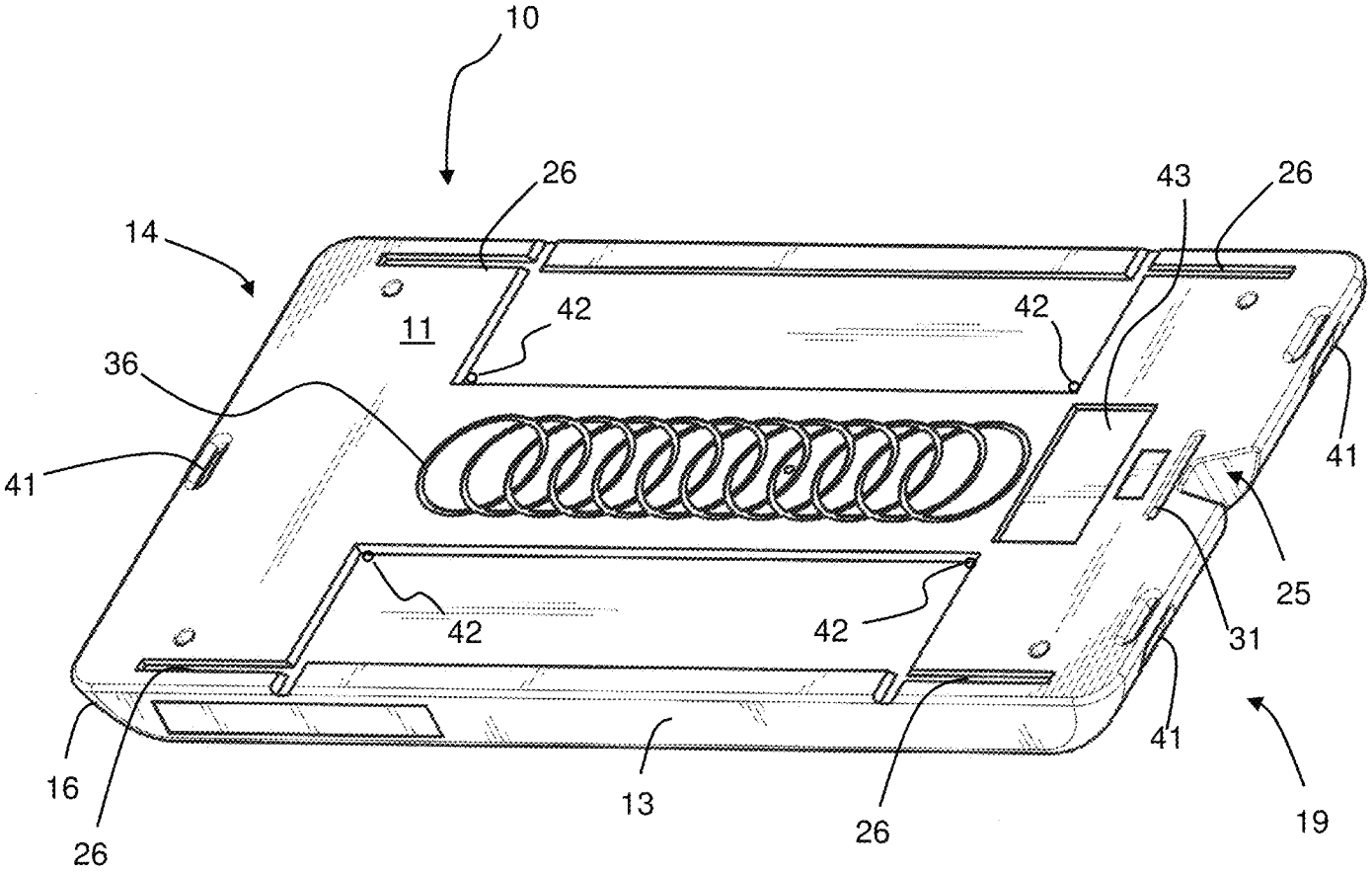
FIG. 12 is a top rear perspective of another embodiment of the raft.

In another embodiment, the bow and the stern have the same curvature as shown in FIG. 11A plus an additional radius of curvature on the port and starboard sides, as indicated in FIG. 11C, to form a rounded deck edge, as shown in FIGS. 1-4 and 12. As shown in FIG. 11C, for a raft that has a deck of 48×96×6 inches, radius r=8.5625 inches, the distance from the center of the circle to the end of the raft a is about 8.1 inches, b is about 3.0 inches and c is about 5.1 inches.

The deck 11 and the bottom 12 are rectangles of equal width. The deck 11 is longer than the bottom 12 due to the shortening of the bottom 12 to accommodate the curvature of the bow 16 and stern 17. In one embodiment the width of the deck is half the length. In a preferred embodiment the deck is 48 inches wide and 96 inches long, the bottom is 48 inches wide and 80 inches long, and the raft is 6 inches thick. The preferred embodiment of the raft is sized to fit in the bed of a pick-up truck.

The raft has a foam core. Suitable materials include extruded polystyrene foam, expanding marine polyurethane foam, aerogel, Airloy™, expanded polystyrene foam, spray foam, closed-cell-foam, polyisocyanurate, cross linked PE foam, plastic foam, polymers, and carbon. In one embodiment the foam is a closed cell, pourable foam, which resists the absorption of water. In a preferred embodiment the foam is closed-cell polyurethane having a density of about 1-2 $lb/ft^3$. The raft may be formed by molding, rotational molding, blow-molding, or cutting blocks or sheets of foam into the desired shape. The edges may be sharp corners but are typically slightly rounded, which serves to prevent mechanical damage and to help a molded raft release from its mold.

A coating is applied to the core to give it a harder outer shell to help prevent mechanical damage and to improve water resistance. Suitable materials include, composite coating, spray/brush/roll-on polyurea, graphine, polyethylene, fiberglass, fiber-reinforced-polymers, nanomaterials, carbon-fiber-reinforced-polymers, ceramics, and rubber. If the shell is rotational molded or blow molded then filled with the foam, the coating is preferably polyethylene. If the raft is first shaped of foam then coated, the coating is preferably polyurea.

Figure 13:
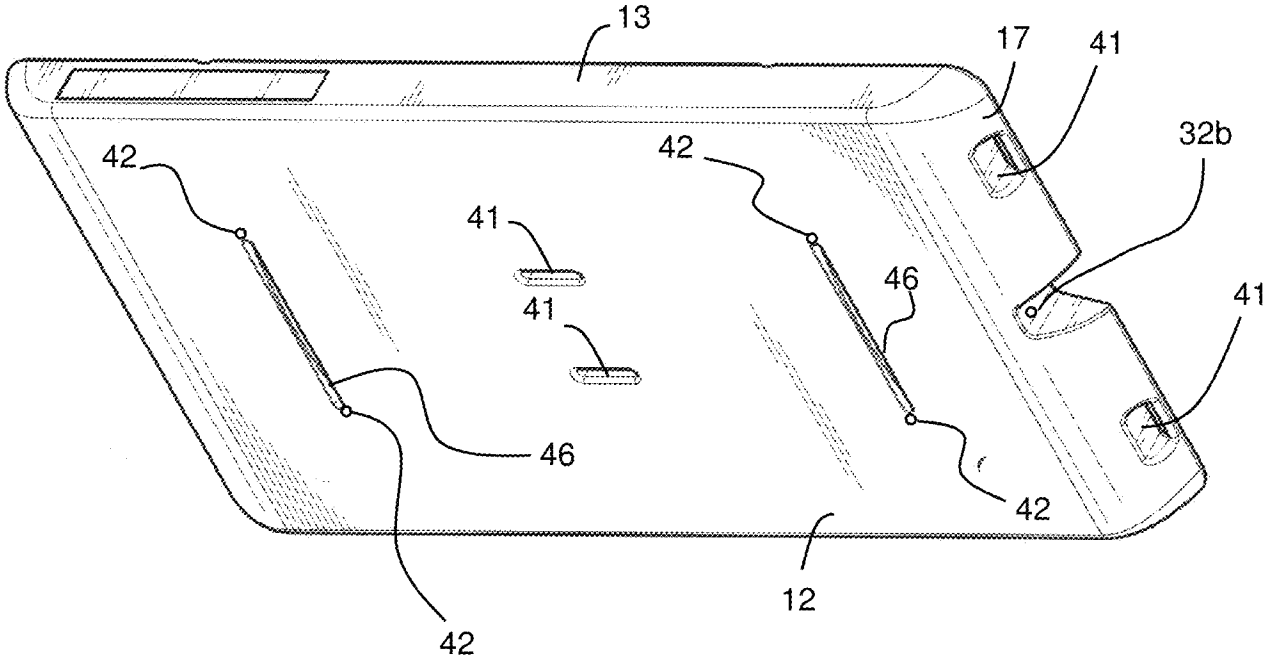
FIG. 13 is a bottom rear perspective of another embodiment of the raft.
Figure 17:
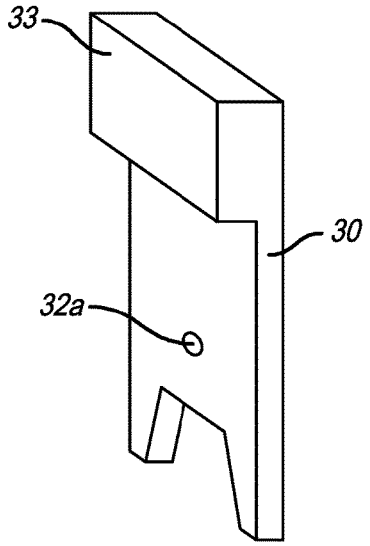
FIG. 17 is a perspective view of a removable motor mount.

Although primarily a stationary watercraft, the raft 10 is steerable and may be propelled by a paddle or a motor to get to a desired location. In one embodiment a trolling motor 34 is attached to the raft 10 at the stern 17. FIG. 17 shows the motor mount 30 and FIG. 18 shows the motor mount 30 inserted in the recess 31 in the raft. The motor mount 30 is removably secured to the raft 10 by inserting a pin through the stern 32*b*, as shown in FIG. 13, and into a mated motor mount aperture 32*a*. In a preferred embodiment the raft has a recess 25 in the stern and rear of the deck to make room for the trolling motor 34 to pivot without rubbing against the raft. See FIGS. 12, 13 and 18. The trolling motor 34 is removably fixed with one or more clamps 35 to the motor mount 30 at the lip 33. Note that the motor mount 30, also known as transom, is turned with the motor mount lip 33 facing rearward, which increases the space between the most forward-facing part of the motor mount and the front of the deck. Although only an inch or two, that small gain increases the area on the deck for the user and his gear by several percent. It also moves the motor shaft back a small percentage to help it clear the small amount of deck behind the motor mount. The deck 11 may also have a recess 43 sized to receive the bottom edge of a battery (not shown) for the trolling motor.

Figure 22:
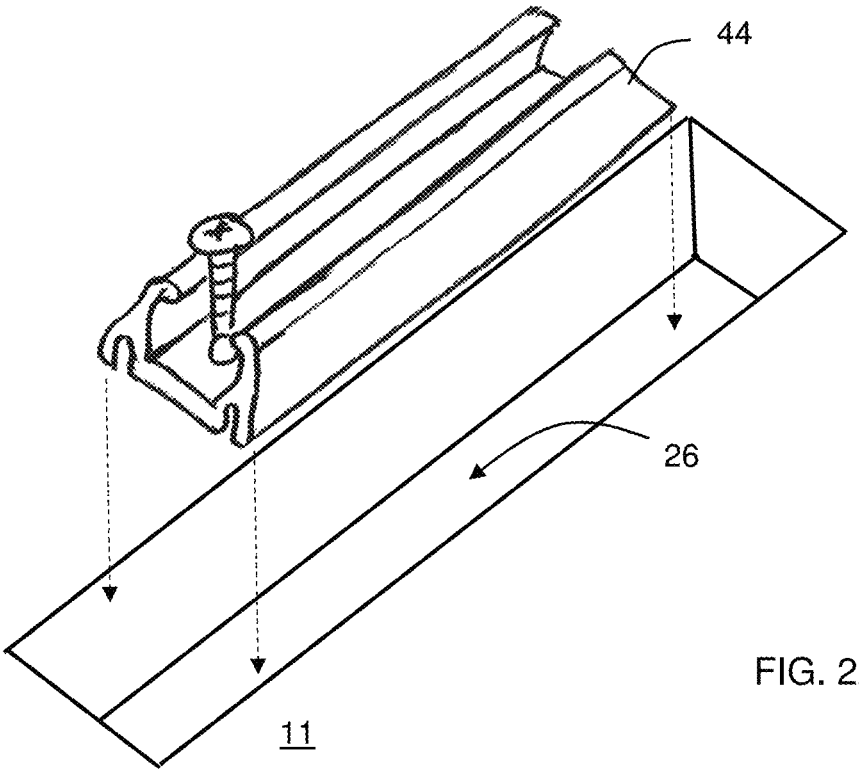
FIG. 22 shows a perspective view of an accessory track above the accessory recess.
Figure 23A:
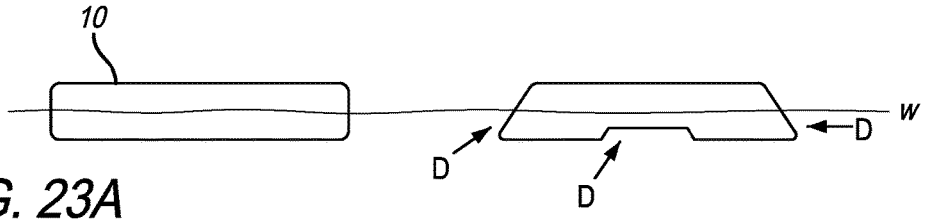
FIG. 23A PRIOR ART
FIGS. 23A-D illustrate rear views of prior art watercraft compared to the present invention.
Figure 23B:
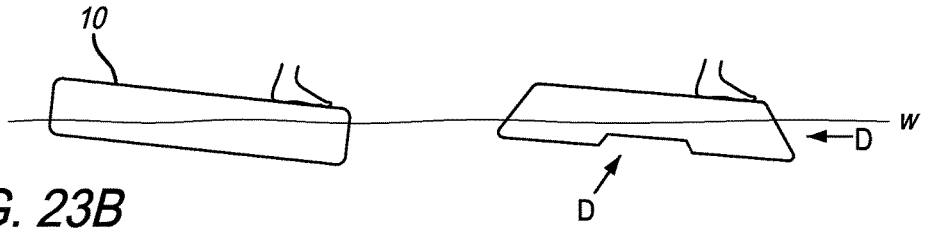
FIG. 23B PRIOR ART
Figure 23C:
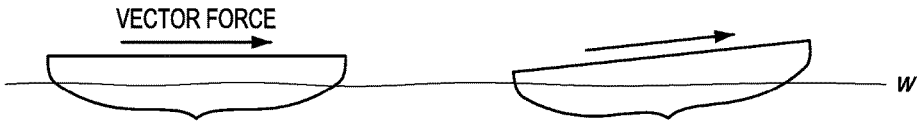
FIG. 23C PRIOR ART
Figure 23D:
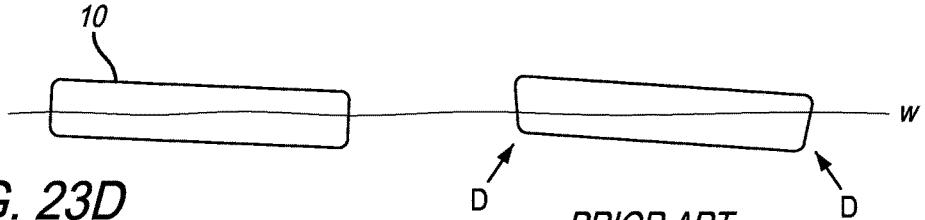
FIG. 23D PRIOR ART

The raft 10 may have a recess 26 in the deck 11 to receive an accessory track 44. See FIG. 22. The accessory track may be removably attached with mechanical fasteners or permanently attached with adhesives. The accessory track has a groove that is shaped to receive mated accessories, such as cleats, paddle holders, anchor holders, tie-down mounts, fishing rod holders, camera mounts, cupholders, etc.

Figure 14:
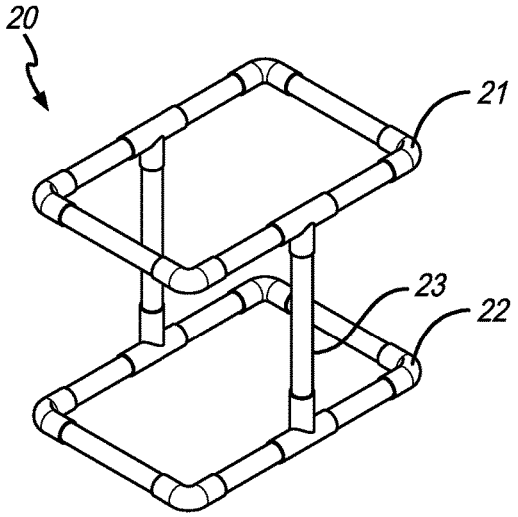
FIG. 14 is a perspective view of a coupler.
Figure 15:
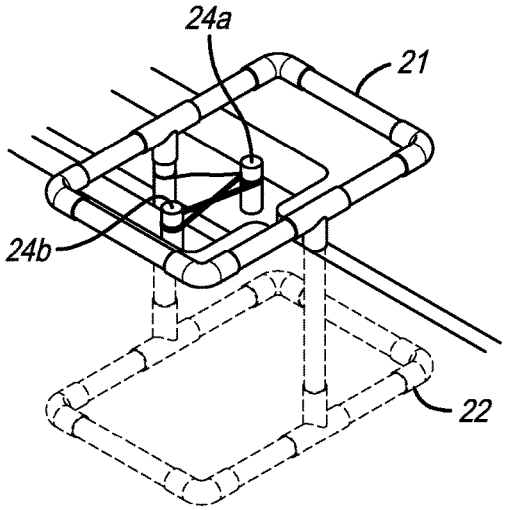
FIG. 15 is a close-up partial view of a coupler connecting two rafts.
Figure 16:
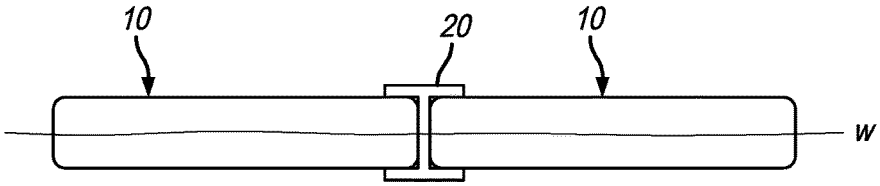
FIG. 16 is a rear view of two coupled rafts.

To increase the area of the deck significantly, one or more rafts 10 can be removably attached together. In one embodiment a coupler 20 is used to removably attach a first raft 10 to a second raft 10. The coupler 20 may comprise a top jaw 21 and a bottom jaw 22 separated by one or more posts 23. A preferred embodiment of a coupler is shown in FIGS. 14-16. The coupler 20 is used to attach two rafts together by positioning one end or side of one raft between the top jaw 21 and the bottom jaw 22, abutting one side of a post 23. An end or side of the second raft is disposed between the top jaw 21 and the bottom jaw 22, abutting the opposing side of the post. The jaws of the coupler may be resilient and hold the rafts secure in the jaws, but preferably each raft is tied to the coupler 20 and thus to each other. FIG. 15 shows a coupler 20 tied to a cleat 24*a* in the first raft to a cleat 24*b* of a second raft. The cleats are fixed in the accessory track 44 of the raft (as described above). The shape of the coupler allows the two rafts to remain stable while an occupant moves closer the coupler because the coupler transfers the weight at the edge of one raft from that raft to the other raft, while holding the rafts together in close proximity. The now-larger raft still has a flat deck and bottom, and perpendicular sides 13 and 15. FIG. 16 shows two rafts coupled together with waterline w. The jaws and posts are typically rigid, but may also be resilient. Couplers can be made of any rigid material that will withstand the forces of transferring mass from one raft to the next. One such material is PVC pipe.

The raft may be equipped with a number of other features that serve to make the raft more suitable for fishing. The deck 11 may have a safety line 45 attached to the raft, to secure gear to the raft. See FIG. 19. The safety line may be attached to the raft using anchoring hardware affixed to the deck or in the accessory track, through the deck, or tied around the whole raft. In one embodiment, four through-holes 42 are made in the raft, extending from the deck 11 to the bottom 12. See FIG. 19. A rope is wound through the through-holes 42, above the deck and below the bottom. In a preferred embodiment, a recess 46 is made in on the bottom 12 of the raft through which the safety line runs to keep it from snagging on things in the water under the raft. See FIG. 13. Gear may be attached to a safety line 45 with carabiners 40 or other releasable fastener.

Figure 19:
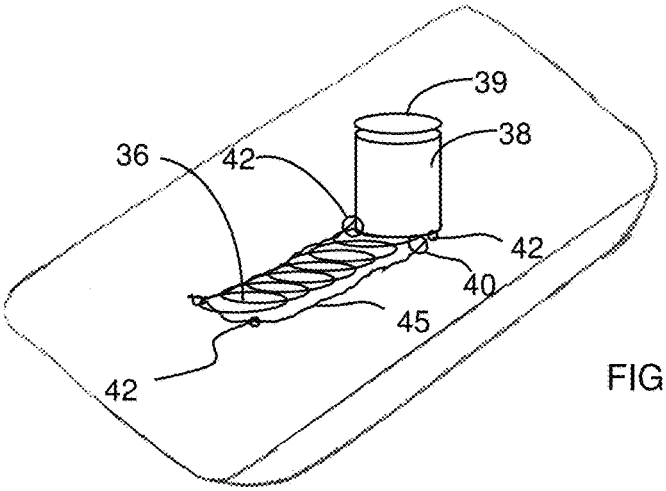
FIG. 19 is a top perspective view of the raft illustrating a bucket seated in a recess.
Figure 20:
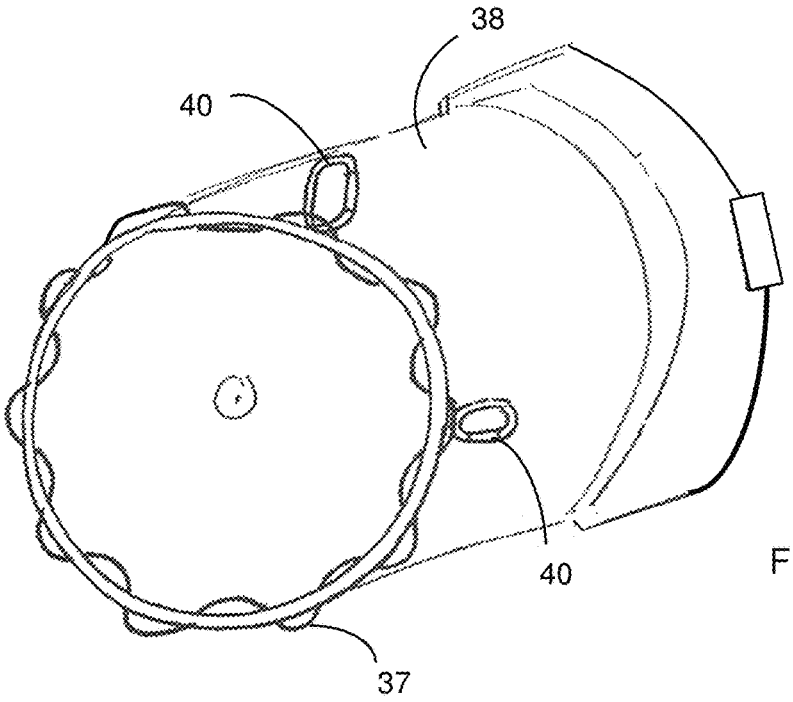
FIG. 20 is a bottom perspective view of a bucket seat.

FIG. 19 also shows a series of bucket recesses, each 36, in the deck 11. Each bucket recess 36 is sized to receive the bottom edge of a bucket 38, which is convenient for holding small loose items and for serving as a seat. The bucket 38 preferably has a seat top 39 or swivel seat top for the raft user to sit on. The bucket 38 can be positioned at the desired location on the raft by inserting the bucket 38 into the bucket recess 36. The desired location may depend on how the mass of gear on the raft is distributed, the best vantage point for viewing fish or prey, best position for controlling the trolling motor, etc. The bucket 38 may have holes in its bottom or bottom flange through which a cord 37 is threaded, which in turn may be attached to the safety line 45 with carabiners 40 or other releasable fastener. See FIG. 20. With the bucket attached to the cord 37 with moveable fasteners, the bucket can easily be moved while the raft is in use without fear it will be lost overboard.

Figure 21A:
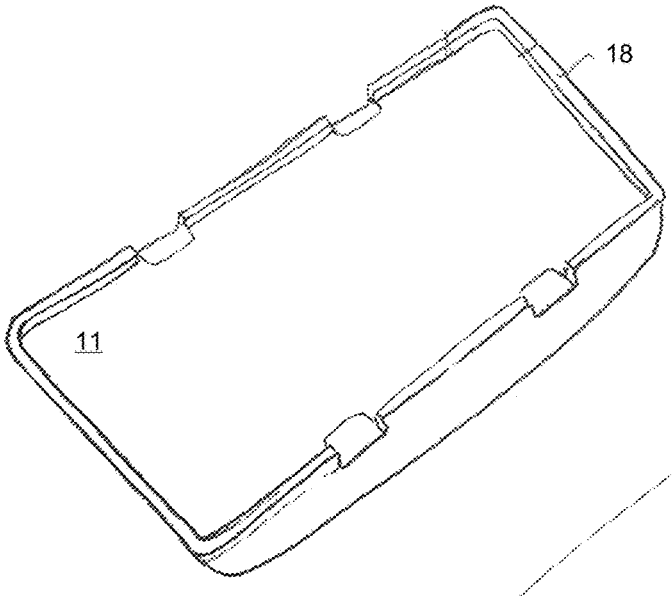
FIG. 21A is a top perspective view of the raft showing the raised lip.
Figure 21B:
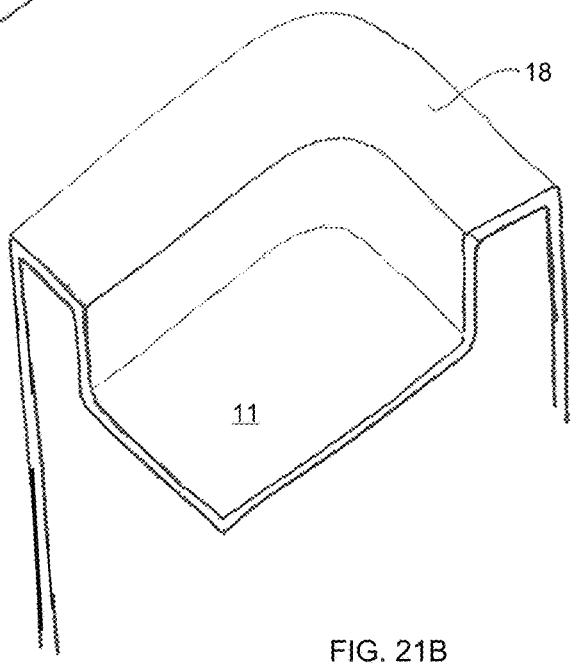
FIG. 21B is a close-up view of the raised lip.

The deck 11 may have a lip 18 around the perimeter of the raft, to help keep gear and people from sliding off the raft. See FIGS. 21A-B. The lip 18 may be continuous but may also be discontinuous, to permit any water that gets the deck to easily drain off. The raft 10 may have through-holes at the edges or recesses that can be used as handles 41 to make it easier to carry the raft to and from the water.

In some embodiments the deck may have deep recesses, typically cylindrical, conical, or frustum conical to receive gear such as fishing poles and poles used to support a tent, awning, sunscreen, hunting blind, or pedestal boat seat. In some embodiments the bottom may have deep recesses, again typically cylindrical, conical, or frustum conical, which serve to help a molded raft release from a mold or add dimensional strength to it.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A steerable and stable raft comprising:

a. a deck comprising a flat surface and a perimeter that has a shape in which radius corners connect the sides of a rectangle, the deck having a front and a rear;

b. a bottom comprising a flat surface and a perimeter that has the same shape as the deck, the bottom being parallel to the deck;

c. a port side comprising a flat surface, the port side connecting the deck and the bottom, wherein the port side is perpendicular to the deck and perpendicular to the bottom;

d. a starboard side comprising a flat surface, the starboard side connecting the deck and the bottom, wherein the starboard side is perpendicular to the deck and perpendicular to the bottom;

e. a bow comprising a curved surface connecting the front of the deck to the bottom, wherein the curved surface is an arc of a circle having a radius of 8.5625 inches and the circle's center is spaced above the deck at 2.5625 inches; and f. a stern comprising a curved surface from the rear of the deck to the bottom, wherein the curved surface is an arc of a circle having a radius of 8.5625 inches and the circle's center is spaced above the deck at 2.625 inches.

2. The raft of claim 1 further comprising a recess in the deck near the stern for receiving a removable motor mount.

3. The raft of claim 2 further comprising a trolling motor removably attached to the motor mount.

4. The raft of claim 1 wherein the deck, bottom, starboard side, port side, bow, and stern form a volume which comprises buoyant foam.

5. The raft of claim 4 wherein the foam is a closed-celled rigid foam.

6. The raft of claim 4 wherein the raft floats up to 800 lbs.

7. The raft of claim 1 wherein the deck, bottom, starboard side, port side, bow, and stern form a volume which consists of buoyant foam covered with a waterproof coating.

8. The raft of claim 7 wherein the coating is polyurea or polyethylene.

9. The raft of claim 1 further comprising one or more recessed rings in the deck for receiving a bottom edge of a bucket.

10. The raft of claim 1 connected to a second raft according to claim 1 with a coupler.

11. The raft of claim 10 further comprising a coupler having a top jaw connected to a bottom jaw with a post, wherein the port side of the raft is disposed between the top jaw and the bottom jaw and abuts one side of the post and the starboard side of the second raft is disposed between the top jaw and the bottom jaw and abuts the opposing side of the post.

12. The raft of claim 1 wherein the deck is 4 ft. wide and 8 ft. long and the port and starboard sides are 6 inches deep.

13. A steerable and stable raft having a length, a width, and a depth, the raft comprising:

a. a top surface having a top perimeter and a raised lip around the top perimeter, the top surface having a shape in which radius corners connect the sides of a rectangle, the top perimeter further comprising a port side deck edge, a bow deck edge, a starboard side deck edge, and a rear deck edge;

b. a bottom surface parallel to the top surface, the bottom surface having a bottom perimeter that has the same shape as the top perimeter, the bottom perimeter further comprising a port side bottom edge, a bow bottom edge, a starboard side bottom edge, and a rear bottom edge;

c. a port side between the deck and the bottom, wherein the port side is:

i. perpendicular to the deck along the port side deck edge connecting the port side to the deck; and ii. perpendicular to the bottom along the port side bottom edge connecting the port side to the to the bottom;

d. a starboard side between the deck and the bottom, wherein the starboard side is:

i. perpendicular to the deck along the starboard side deck edge connecting the starboard side to the deck; and ii. perpendicular to the bottom along the starboard side bottom edge connecting the starboard side to the bottom;

e. a bow having a curved surface connecting the bow deck edge to the bow bottom edge, wherein the curved surface comprises an arc of a circle having a radius 42.7% greater than the depth of the raft and the circle's center is spaced above the deck 42.7% of the depth; and f. a rear having a curved surface connecting the rear deck edge to the rear bottom edge, wherein the curved surface comprises an arc of a circle having a radius 42.7% greater than the depth of the raft and the circle's center is spaced above the deck 42.7% of the depth; and g. a recess in the deck near the stern for receiving a removable motor mount for receiving a removable trolling motor.

14. The raft of claim 13 wherein the deck, bottom, starboard side, port side, bow, and stern form a volume which comprises buoyant foam covered with a waterproof coating.

15. The raft of claim 13 further comprising a safety line wound through two or more through-holes in the raft.

16. The raft of claim 15 further comprising a seat attached to the safety line with movable fasteners such that the seat can be relocated from a first position on the raft to second position on the raft while the raft is in use.

17. A steerable and stable raft comprising a first portion coupled to a second portion with a coupler, wherein the first portion comprises:

a) a first deck comprising a flat surface that has a shape in which radius corners connect the sides of a rectangle, the first deck having a front and a rear;

b) a first bottom comprising a flat surface parallel to the flat surface of the first deck and having the same shape as the first deck;

c) a first port side comprising a flat surface, the port side connecting the first deck and the first bottom, wherein the first port side is perpendicular to the first deck and perpendicular to the first bottom;

d) a first starboard side comprising a flat surface, the first starboard side connecting the first deck and the first bottom, wherein the first starboard side is perpendicular to the first deck and perpendicular to the first bottom;

e) a first bow comprising a curved surface connecting the front of the first deck to the first bottom;

f) a first stern comprising a curved surface connecting the rear of the first deck to the first bottom;

and wherein the second portion comprises:

g) a second deck comprising a flat surface that has a shape in which radius corners connect the sides of a rectangle, the second deck having a front and a rear;

h) a second bottom comprising a flat surface parallel to the flat surface of the second deck and having the same shape as the second deck;

i) a second port side comprising a flat surface, the port side connecting the second deck and the second bottom, wherein the second port side is perpendicular to the second deck and perpendicular to the second bottom;

j) a second starboard side comprising a flat surface, the second starboard side connecting the second deck and the second bottom, wherein the second starboard side is perpendicular to the second deck and perpendicular to the second bottom;

k) a second bow comprising a curved surface connecting the front of the second deck to the second bottom;

l) a second stern comprising a curved surface connecting the rear of the second deck to the second bottom;

wherein:

i. the first starboard side is parallel to the second port side;

ii. the raft has a length, a width, and a depth; and iii. the curved surfaces of the first and second bows comprise an arc of a circle having a radius 42.7% greater than the depth of the raft and the circle's center of the circle is spaced above the deck 42.7% of the depth of the raft.

18. The raft of claim 17 wherein the coupler comprises a top jaw connected to a bottom jaw with a post, wherein the first starboard side is disposed between the top jaw and the bottom jaw and abuts one side of the post and the second port side is disposed between the top jaw and the bottom jaw and abuts the opposing side of the post.

19. The raft of claim 17 wherein the first portion and second portion when coupled together have a perimeter and further comprising a discontinuous lip around the perimeter.

* * * * *